US008725055B2

(12) United States Patent
Thayer

(10) Patent No.: US 8,725,055 B2
(45) Date of Patent: May 13, 2014

(54) PIVOTING CLEANING BLADE TO MINIMIZE BLADE STRESS AND PHOTORECEPTOR TORQUE WITH INCREASING FRICTION COEFFICIENT

(75) Inventor: Bruce Earl Thayer, Spencerport, NY (US)

(73) Assignee: Xerox Corporation, Norwalk, CT (US)

( * ) Notice: Subject to any disclaimer, the term of this patent is extended or adjusted under 35 U.S.C. 154(b) by 300 days.

(21) Appl. No.: 13/228,838

(22) Filed: Sep. 9, 2011

(65) Prior Publication Data

US 2013/0064589 A1 Mar. 14, 2013

(51) Int. Cl.
*G03G 21/00* (2006.01)
*A46B 15/00* (2006.01)

(52) U.S. Cl.
USPC ..... 399/351; 399/345; 15/256.51

(58) Field of Classification Search
USPC ..... 399/350, 351, 345, 71; 101/423; 400/701; 15/256.5, 256.51, 256.52, 15/256.53
See application file for complete search history.

(56) References Cited

U.S. PATENT DOCUMENTS

| | | | |
|---|---|---|---|
| 4,026,648 | A | 5/1977 | Takahashi |
| 4,619,523 | A | 10/1986 | Maeda et al. |
| 5,208,639 | A | 5/1993 | Thayer et al. |
| 5,412,461 | A | 5/1995 | Thayer |
| 7,633,647 | B2 | 12/2009 | Mestha et al. |
| 7,877,054 | B1 | 1/2011 | Thayer et al. |
| 2010/0021198 | A1 | 1/2010 | Thayer et al. |

*Primary Examiner* — David Gray
*Assistant Examiner* — Sevan A Aydin
(74) *Attorney, Agent, or Firm* — Ronald E. Prass, Jr.; Prass LLP

(57) ABSTRACT

The cleaning blade is mounted to a holder that is pivoted. The pivot mechanism is designed such that the instantaneous center of rotation of the blade holder, in its operational position, is positioned above the plane of blade tip contact to the photoreceptor and upstream of the blade tip or below the plane of contact and downstream from the blade tip. These configurations result in a reduction of blade load as friction coefficient increases and a slower increase in photoreceptor torque when compared to conventional interference loaded blades. By a careful choice of the location of the center of rotation, the blade load can be maintained at a sufficiently high value for good cleaning over the expected range of friction coefficients. A four bar linkage provides a compact mechanism to pivot the blade holder and avoids potential problems of the mechanism interfering with the process and other components.

20 Claims, 6 Drawing Sheets

PIVOTING CLEANING BLADE TO MINIMIZE BLADE STRESS AND PHOTORECEPTOR TORQUE WITH INCREASING FRICTION COEFFICIENT

BACKGROUND

This disclosure relates in general to copier/printers, and more particularly, to cleaning residual toner from an imaging device surface and reducing cleaning blade failure by controlling blade stress incurred due to increasing coefficient of friction.

In a typical electrophotographic printing process, a photoreceptor or photoconductive member is charged to a uniform potential to sensitize the surface thereof. The charged portion of the photoconductive member is exposed to a light image of an original document being reproduced. Exposure of the charged photoconductive member selectively dissipates the charges thereon in the irradiated areas. This process records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. Toner particles attracted from the carrier granules to the latent image form a toner powder image on the photoconductive member. The toner powder image is then transferred from the photoconductive member to a copy sheet. Heating of the toner particles permanently affixes the powder image to the copy sheet. After each transfer process, the toner remaining on the photoconductor is cleaned by a cleaning device.

Blade cleaning is a technique for removing toner and debris from a photoreceptor, photoconductive member, or other substrate surface within a printing system. In a typical application, a relatively thin elastomeric blade member is supported adjacent to and transversely across the photoreceptor with a blade edge that chisels or wipes toner from the surface. Toner accumulating adjacent to the blade is transported away from the blade area by a toner transport arrangement or by gravity. Blade cleaning is advantageous over other cleaning systems due to its low cost, small cleaner unit size, low power requirements, and simplicity. However, cleaning blades are primarily used in a static mode. The blade is either interference loaded or force loaded and remains in the operating position throughout the start-operate-stop cycle ("operating cycle") of completing printing jobs. The static mode shortens the life of cleaning blades due to failures brought about from interaction with the photoreceptor chiefly at the beginning and ending of the operating cycle. Photoreceptor surface coatings while improving photoreceptor life typically results in far higher blade wear rates due to an increase in the coefficient of friction. A higher friction coefficient against the cleaning blades leads to increased torque and scratching problems. These problems can also contribute to future cleaning problems of toners from a photoreceptor surface.

Cleaning blades are typically designed to operate at either a fixed interference or fixed blade load as disclosed in U.S. Pat. No. 5,208,639 which is included herein by reference. Because of blade relaxation and blade edge wear over time, part and assembly tolerance, and cleaning stresses from environmental conditions and toner input, the cleaning blade is initially loaded to a blade load high enough to provide good cleaning at extreme stress conditions for all of the blade's life. However, a higher than required blade load causes the blade and charge retentive surface to wear more quickly. Overcoated charge retentive surfaces have been developed to reduce the wear rate. While an overcoat protects the charge retentive surface, the overcoats frequently increase the wear rate of the blades.

In interference loading, the blade is hard mounted to a frame to create the blade load against the photoreceptor. Over time the blade material relaxes and the blade load decreases somewhat from its initial value. Force loaded blades are mounted on a pivoted blade holder. The blade load is created by a weight or spring pressing against the blade holder that transmits a force to the blade tip. Over time the blade material creeps and the working angle is reduced somewhat from its initial value. Further, increases in friction due to blade age, lubrication depletion, and hardened toner lodged in the surface adds to blade stress further diminishing its effectiveness. Pivoted blade holders have traditionally been designed with their pivots located on the plane of blade tip contact. With this arrangement, the friction force, in the plane of tip contact acts through the pivot point and does not create a moment around the pivot and thus prevents any changes in blade normal load. As a consequence traditional blade holders do not take advantage of the variations in blade load caused by changes in the coefficient of friction.

Alternatives for operating a cleaning blade in high friction conditions have included methods to reduce the blade-photoreceptor friction, increasing the available torque to drive the photoreceptor, increasing the strength of the blade and optimizing cleaning blade parameters. Friction reduction concepts include additional developed toner (e.g., stripes developed in the inter-document zones), lubricating additives in the toner (e.g., zinc stearate), lubricating additives in the photoreceptor surface (e.g., PTFE), lubricating additives in the blade, and application of additives directly to the photoreceptor surface (e.g., zinc stearate). Historically friction reduction concepts have been marginally successful in very high friction conditions. Lubricating toner additives, PTFE photoreceptors and zinc stearate applicators have been the most successful alternatives. Increasing photoreceptor drive motor torque can avoid the photoreceptor stall problem with high friction, but unless blade life requirements are quite short, blade edge damage will still be an issue. Current blade materials have evolved to the point where little opportunity exists for significant increases in strength and blade life under high friction conditions. Harder blade materials may provide some life advantage and they typically have lower friction coefficients, but the improvement from blade material is unlikely to be sufficient by itself. Lower cleaning blade working angles, lower blade loads and optimized cut angles can provide some benefit in reducing blade edge stress, but again, probably not enough to solve a high friction problem alone. All of these alternatives involve some trade-off to obtain the improved blade life and lower photoreceptor drive torque, especially system interactions with the addition of lubricants. The pivoting blade concept provides a very significant reduction in photoreceptor drive torque and blade edge stress and can be combined with many of these alternatives for even greater improvements.

For the reasons stated above, and for other reasons stated below which will become apparent to those skilled in the art upon reading and understanding the present specification there is need in the art for a cleaning system that adapts to increases friction by decreasing blade load.

SUMMARY

According to aspects of the embodiments, there is provided an apparatus and method to manage the contact of a cleaning blade and a surface to increase the useful life of the blade. The cleaning blade is mounted to a holder that is pivoted. The pivot mechanism is designed such that the instantaneous center of rotation of the blade holder, in its operational position against the photoreceptor, is positioned above the plane of blade tip contact to the photoreceptor and upstream of the blade tip or below the plane of contact and downstream from the blade tip. These configurations result in a reduction of blade load as the blade-photoreceptor friction coefficient increases and a slower increase in photoreceptor torque when compared to conventional interference loaded blades. By a careful choice of the location of the center of rotation, the blade load can be maintained at a sufficiently high value for good cleaning over the expected range of friction coefficients. A four bar linkage provides a compact mechanism to pivot the blade holder and avoids potential problems of the mechanism interfering with the process and other components.

DETAILED DESCRIPTION

Figure 1:
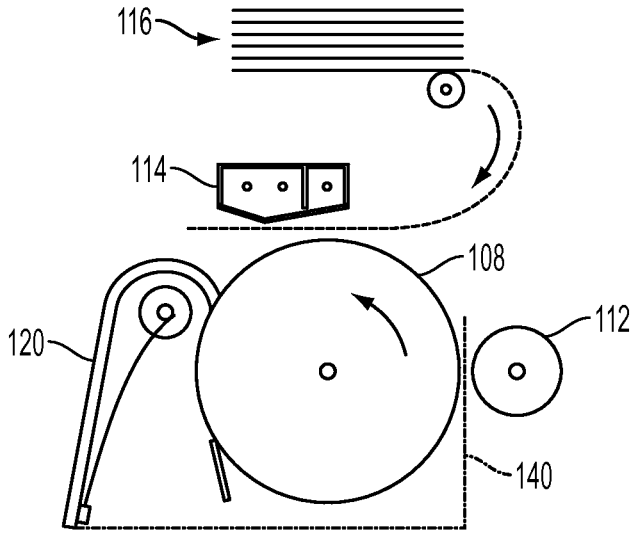
FIG. 1 is a simplified elevational view showing relevant elements of an electrostatographic or xerographic printing, in accordance to an embodiment.

In accordance with various aspects described herein, systems and methods are described that facilitate cleaning a photoreceptor surface in a xerographic imaging device using cleaning blades. In order to greatly reduce blade stress incurred during the operation cycles the disclosed invention adjusts the load on the blade in response to a change in the coefficient of friction. The stress induced by friction contact between the blade and the photoreceptor primarily increases the normal force leading to fatigue failure and edge tearing. This disclosure proposes the use of a pivoted, force loaded cleaning blade that adapts to increases in blade-photoreceptor friction by decreasing blade load. The pivot of the blade holder is offset from the plane of the blade tip contact such that the moment created by the friction force (μN), in the plane of contact, reduces blade load (N) and reduces the amount of increase in the friction force (μN). A pivot location is chosen such that as the friction coefficient increases the blade normal force decreases. In addition, any selected pivot location must insure that the blade load at the maximum expected friction coefficient is sufficiently high to provide good cleaning performance.

Aspects of the disclosed embodiments relate to a pivoted cleaning blade mount to remove residual material from a moving surface comprising a blade member supported such that a blade tip on the blade member is biased towards the path of the moving surface, wherein the blade tip forms a first plane at a contact angle with a tangent to the moving surface; and a mechanism supporting pivotably the blade member having a virtual pivot point in a second plane offset from the first plane; wherein the virtual pivot point is selected to reduce stress on the blade tip due to changes in coefficient of friction caused by aging or reduction in lubrication at the moving surface.

In still another aspect the pivoted cleaning blade mount disclosed embodiments include a mechanism selected from a group consisting of board mounts, link rods, link rod clamps and mixtures thereof.

In still another aspect the pivoted cleaning blade mount disclosed embodiments include a blade member supported along its entire extent by one of the board mounts.

In still another aspect of the pivoted cleaning blade mount disclosed embodiments the blade member support is adapted to be mounted for pivotal movement.

In still another aspect of the pivoted cleaning blade mount disclosed embodiments the mechanism is biased by means of a compression spring, tension spring, torsion spring or weight attached to the support.

In still another aspect of the pivoted cleaning blade mount disclosed embodiments the mechanism includes link rods connected to the board mounts.

In still another aspect of the pivoted cleaning blade mount disclosed embodiments the link rods rotate within the link rod clamps.

Further aspects of the disclosed embodiments include an apparatus for treating a substance on a surface of a component comprising a body comprising a free end portion including a first surface, the body being comprised of an elastomeric material; a fixed end opposite to the free end portion and fixedly secured to a mechanism supporting pivotably the body, wherein the body is pivoted about a virtual pivot point; a second surface opposite to the first surface; and a spring or weight adapted to apply a load to the body such that the first surface of the body treats the substance on the surface of the component, wherein the spring or weight applies a force to the second surface of the body at the free end portion through the mechanism; wherein the virtual pivot point is selected to reduce stress on the first surface of the body due to changes in coefficient of friction caused by aging or reduction in lubrication at the component.

In still another aspect the disclosed embodiment is directed to a method of treating a substance on a surface of a component in a printing apparatus with a blade member made of elastomeric material on a pivoted cleaning blade mount, the method comprising applying a load to the blade member by pivoting the mechanism about a virtual pivot point; and adjusting the load to the blade member to reduce stress due to changes in the coefficient of friction caused by aging or reduction in lubrication at the component.

The term "print media" generally refers to a usually flexible, sometimes curled, physical sheet of paper, plastic, or other suitable physical print media substrate for images, whether precut or web fed.

The term "image forming machine" as used herein refers to a digital copier or printer, electrographic printer, bookmaking machine, facsimile machine, multi-function machine, or the like and can include several marking engines, as well as other print media processing units, such as paper feeders, finishers, and the like. The term "electrophotographic printing machine," is intended to encompass image reproduction machines, electrophotographic printers and copiers that employ dry toner developed on an electrophotographic receiver element.

The term "blade degradation" as used herein refers to a reduction in the functionality of a blade due to wear and contamination. The blade degradation is proportional to how long the blade has been in use; i.e. the blade age.

As used herein relational terms such as "first," "second," and the like may be used solely to distinguish one entity or action from another entity or action without necessarily requiring or implying any actual such relationship or order between such entities or actions. Also, relational terms, such as "offset", "upstream", "downstream", "top," "bottom," "front," "back," "horizontal," "vertical," and the like may be used solely to distinguish a spatial orientation of elements relative to each other and without necessarily implying a spatial orientation relative to any other physical coordinate system. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

Figure 5:
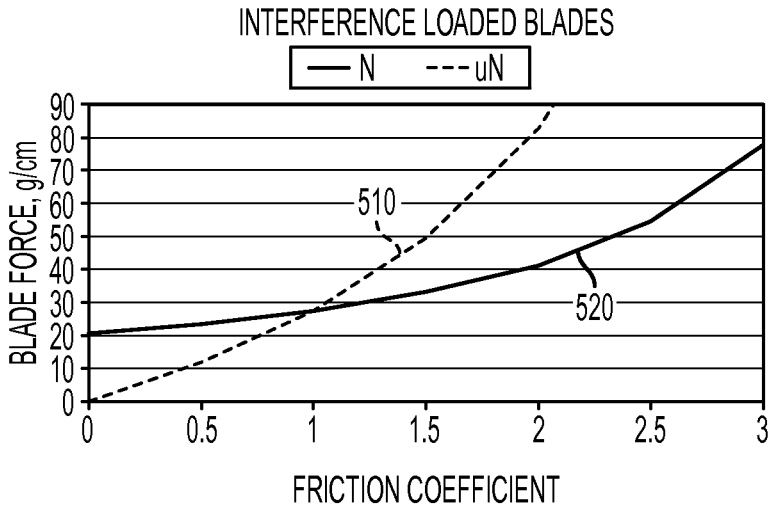
FIG. 5 shows curves illustrating the relationship of blade forces and the friction coefficient on blade load (N) in accordance to an embodiment.

FIG. 5 shows curves illustrating the relationship of blade forces and the friction coefficient on blade load (N) in accordance to an embodiment. FIG. 5 illustrates that when the coefficient of friction increases, possibly due to an overcoated photoreceptor, there is an increase in the friction force (μN) 510 and in the blade load (N) 520. In some instances there is a rapid increase in both blade load and friction with increases in friction coefficient. As an example, in the case of an interference loaded blade where the coefficient of friction (COF) is raised from 1.5 to 2 there is an increase blade load (N) of roughly 8 g/cm and a friction force of roughly 30 g/cm.

Figure 6:
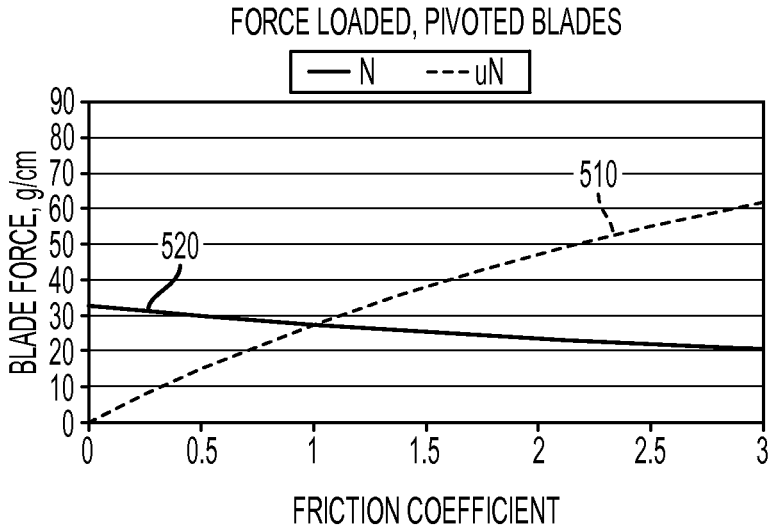
FIG. 6 shows curves illustrating the relationship of blade forces and the friction coefficient on blade load (N) after adjustment of the blade in accordance to an embodiment.

FIG. 6 shows curves illustrating the relationship of blade forces and the friction coefficient on blade load (N) after adjustment of the blade load in accordance to an embodiment. FIG. 6 shows that by positioning the pivot location of the blade mechanism one can lower the blade normal force (N) with an increase in the coefficient of friction (COF). However, the pivot location must be chosen so that the blade load (N) 520 at the maximum expected friction coefficient (3 in this case) is sufficiently high to provide good cleaning performance. The blade load to provide good cleaning can range from about 15 g/cm to about 60 g/cm with other suitable ranges including from about 25 g/cm to about 35 g/cm. It must be emphasized, however, that too high a blade load results in lower blade life and reliability. As shown here in FIG. 6 at a COF of 3 the blade load is 20 g/cm. It should be noted which will be clear from the reading of the description of holder 300 (FIG. 2 and FIG. 3) that the positioning of the virtual pivot point regulates the magnitude of the blade load so that a minimum value of 30 g/cm (@ 3 COF) is more than possible.

FIG. 1 is a schematic elevational view of a printing machine including a cleaning system in accordance to an embodiment. In the simplified elevational view the relevant elements of an electrostatographic or xerographic printing apparatus, many of which are disposed within a module housing generally shown as 140. As is well known, an electrostatic latent image is created, by means not shown, on a surface of a charge receptor or photoreceptor 108. The latent image is developed by applying thereto a supply of toner particles, such as with developer roll 112, which may be of any of various designs such as a magnetic brush roll or donor roll, as is familiar in the art. The toner particles adhere to the appropriately-charged areas of the latent image. The surface of photoreceptor 108 then moves, as shown by the arrow, to a transfer zone created by a transfer-detach assembly generally indicated as 114. Simultaneously, a print sheet on which a desired image is to be printed is drawn from supply stack 116 and conveyed to the transfer zone 114 as well. At the transfer zone 114, the print sheet is brought into contact or at least proximity with a surface of photoreceptor 108, which at this point is carrying toner particles thereon. A corotron or other charge source at transfer zone 114 causes the toner on photoreceptor 108 to be electrically transferred to the print sheet. The print sheet is then sent to subsequent stations, as is familiar in the art, such as a fuser and finishing devices (not shown). Following transfer of most of the toner particles to the print sheet in the transfer zone, any residual toner particles remaining on the surface of photoreceptor 108 are removed at a cleaning station, which is generally indicated as 120. Other exemplary printing systems are disclosed in U.S. Pat. No. 7,633,647 (Meshta et al), which is incorporated herein by reference in its entirety.

Apparatuses useful in printing, fixing devices and methods of stripping media in apparatuses useful in printing are provided. The apparatuses are constructed to allow different types of marking material to be treated on different types of media. The apparatuses include a photoconductive surface such as a drum. The drum can be heated to supply thermal energy to media contacting the drum. The apparatuses are constructed to allow different types of media to be stripped from the photoconductive surface or drum. After the print media is separated from photoconductive surface such as photoreceptor 108, the residual toner/developer and any paper fiber particles adhering to photoconductive surface are cleaned at a cleaning station (not shown). A cleaning station for a printing apparatus is disclosed in U.S. Pat. No. 7,877,054 issued on Jan. 25, 2011 to Thayer et al. which is included herein by reference. Generally a cleaning station includes a housing and may contain a rotatably mounted fibrous brush in contact with photoconductive surface or drum to disturb and remove paper fibers and a cleaning blade such as blade 210 to remove the non-transferred toner particles. The blade can typically be made of an elastomeric material which can be characterized by its elastic modulus. The cleaning blade may be configured in either a wiper or doctor position depending on the application. Subsequent to cleaning, a discharge lamp (not shown) floods photoconductive surface with light to dissipate any residual electrostatic charge remaining thereon prior to the charging thereof for the next successive imaging cycle.

Figure 2:
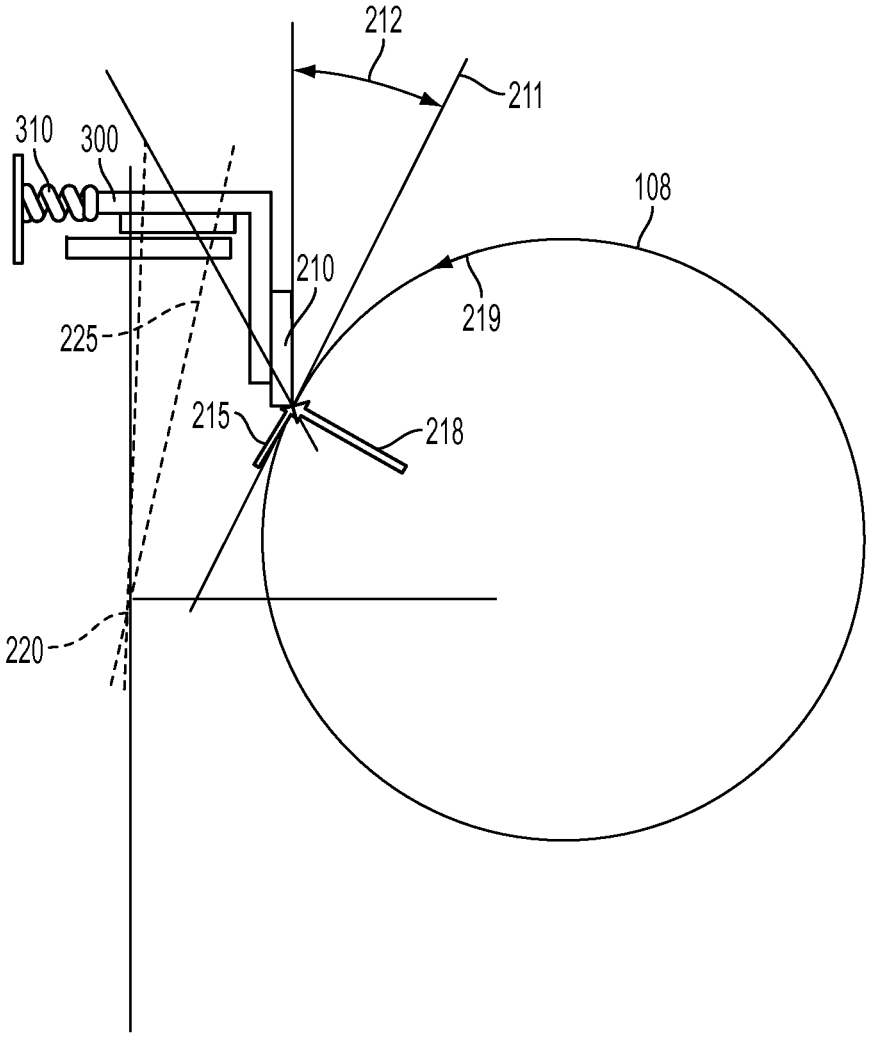
FIG. 2 is an illustration of a virtual pivot point and a four-bar linkage pivoted cleaning blade mount in accordance to an embodiment.

FIG. 2 is an illustration of a virtual pivot point and a four-bar linkage pivoted cleaning blade mount in accordance to an embodiment. The cleaning apparatus comprises a blade 210 having a toner-scraping top end, a holder 300 for supporting a base of the blade 210, a swivel in holder 300 for pivotably supporting the blade and a bias means 310 such as a compression spring for pressing the top end of the blade 210 to the surface of a photosensitive drum 108. The pivot mechanism or holder 300 is designed such that the instantaneous center of rotation of the blade holder such as pivot point 220, in its operational position against the photoreceptor drum, is positioned above the plane of blade tip contact to the photoreceptor and upstream of the blade tip (currently shown in FIG. 2) or below the plane of contact and downstream from the blade tip. The angle 212 the blade 310 makes with the photoreceptor drum (cylinder) depends on two things: the position, relative to the cylinder surface, of the link containing the blade; and the blade slope at the blade-to-cylinder contact point. The holder 300 rotation moves the link containing the blade. The blade slope is superposed atop the link angle and completes the determination of blade angle at the contact point. Overcoated photoreceptors have shown to exhibit an increasing coefficient of friction (CoF) over time, leading to premature cleaning failures in normal interference loaded blade configurations. The use of the linkage, in concert with a loading spring, reduces the normal force of the blade against the drum as the frictional forces rise due to increasing CoF as the drum ages or toner lubrication is low. By using the proposed force loading method, the photoreceptor torque and Xerographic Replaceable Unit (XRU) run cost can be reduced by improving the reliability of the cleaning system. The low profile nature of the four bar linkage allows the design to be incorporated in small, compact XRUs.

The holder 300 for supporting the base of the blade 210 is arranged on the side opposite to the photoreceptor drum 108 with respect to the blade 210, and the holder 300 and blade 210 are arranged so that the angle (Φ) 212 between the top end of the blade 210 and the moving surface of the photoreceptor drum 108 is appropriate for good cleaning (typically within a range of 5° to 30°). As shown in FIG. 2 the bias means 310 such as a spring exerts a force (K) in a direction that causes the holder 300 to swivel causing the blade 210 to make contact with photoreceptor drum 108. The contact between the surfaces causes a blade load (N) 218 and friction force (μN) 215 to develop at the point of contact. The coefficient of friction (μ) is a measure of the static and dynamic forces as materials are sheared against each other and can be measured by a variety of techniques as known to those in the art. These forces are a function of material surface energy, normal force, molecular attachment, roughness and surface speed. It follows then that the stress on the blade edge which leads to fatigue failure and edge tearing is influenced primarily by the normal force (blade load 218) and the friction load (friction force 215) which is a function of the coefficient of friction (μ) and blade load (N). It would be advantageous to have a coefficient of friction (μ) for the blade be low so as to allow the blade 210 to slide smoothly over the photoreceptor drum 108 in order to reduce or eliminate stress such as chattering of the blade against the drum which increases blade failure. However, overcoats on the photoreceptor surface (drum) to improve scratch and wear resistance, and surface changes due to charging and environmental conditions all act to dynamically change the coefficient of friction and make it difficult to achieve low friction for a prolonged period of time. An additional option for reducing friction is to manage the normal force since it is correlated to the coefficient of friction.

Figure 3:
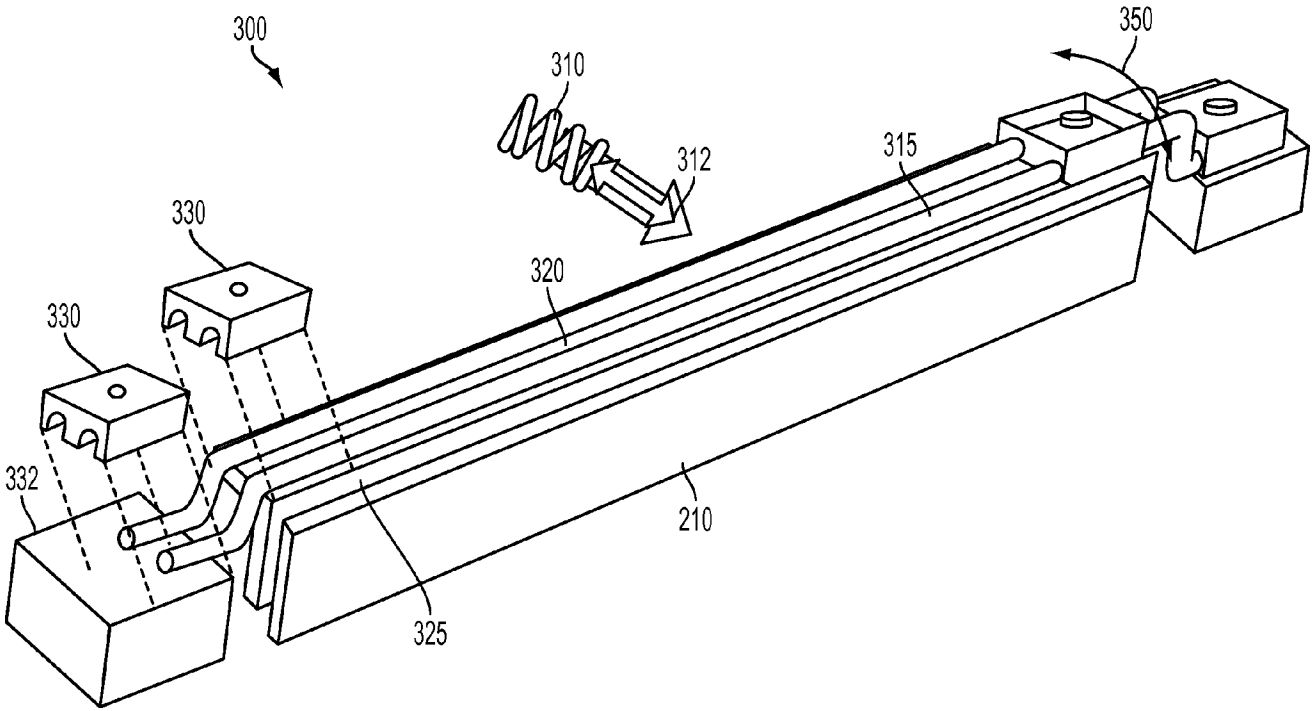
FIG. 3 is an illustrates a component view of a compact four-linkage pivoted cleaning blade mount in accordance to an embodiment.
Figure 4:
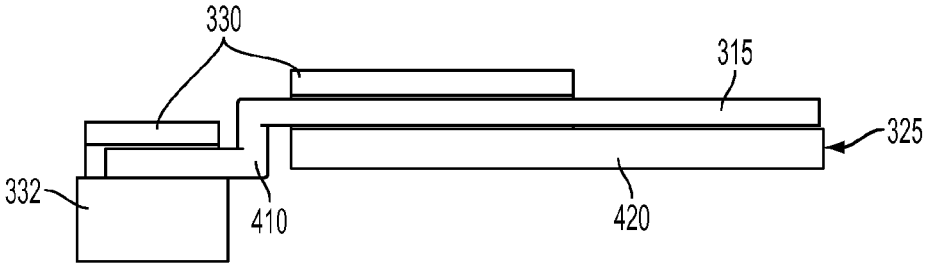
FIG. 4 is a side view of a compact four-linkage pivoted cleaning blade mount in accordance to an embodiment.

Holder 300 is positioned to reduce the normal force as the friction coefficient increases. This position enables operation of existing cleaning blade technology at significantly higher friction coefficients. The use of linkages as shown in FIGS. 2-4, in concert with a loading spring, reduces the normal force 218 on blade 210 as the frictional forces rises as a result of drum and blade aging, and reduction in lubrication as evidenced by a rise in the coefficient of friction. The bias means 310 (e.g. torsion spring, tension spring, compression spring) supplies a force which creates the blade normal load 218. The holder 300 is located such that, when the blade 210 is loaded against the photoreceptor drum 108, lines passing 225 through the holder 300 intersect on a second plane offset from the first plane 211 which is tangent to the photoreceptor drum. The point where these lines intersect is called the instantaneous center of rotation or the virtual pivot point (VPP) 220. The advantage of this arrangement is that it is affected by the friction force (μN) 215 and it can be used on a printing apparatus without interfering with the photoreceptor removal. The advantage is seen from kinematic model around the virtual pivot point 220.

The various forces on the blade 210 such as blade load, friction, and other system forces tend to rotate the blade and the holder 300 about its virtual pivot point 220. During operation, that is before there is an increase in the friction force the holder 300 is in a quasi-steady-state with no net angular acceleration, all moments about the VPP 220 sum to zero to maintain the state. As the system begins to change, evidenced by a change in the coefficient of friction, the blade has to absorb the extra energy from the increase in friction which results in over-loading of the blade The holder 300 in FIG. 2 is arranged so that the holder is associated with each force (load, friction and the like) through fixed structure lengths such links described in FIG. 3 and variable angles depended primarily on the blade. This is determined by a summation of the moments, $M_{220}$, about the virtual point 220. The summation is calculated using the following equations:

$$\Sigma M_{220}=aK-bN-c\mu N \quad \text{EQ. 1}$$

$$\Sigma M_{220}=0 \quad \text{EQ. 2}$$

At quasi-steady-state:

$$K=\left(\frac{b+c\mu}{a}\right)N \quad \text{EQ. 3}$$

In the above equations a, b and c are the distances perpendicular to the Blade load (N), friction force (μN), and the bias force (K) applied by the bias means 310 such as a compression spring to the virtual pivot point 220. EQ. 3 demonstrates that the moment created by the friction force, in the plane of contact, reduces blade load (N) and reduces the amount of increase in the friction force (μN). Further from the above equations, especially from EQ. 2, during quasi-steady-state part of the blade load (N) is transferred to bias means 310 at coefficient of friction higher than 1 and at coefficient of friction lower than 1 the blade load (N) receives energy from the bias means. FIG. 6 graphically shows how pivot location can be chosen such that as the friction coefficient increases the blade normal force decreases. The use of a four-bar linkage, see FIG. 3, pivot for the blade 210 would reduce blade load and torque as the friction coefficient between the blade and the photoreceptor surface increased.

FIG. 3 illustrates a component view of a compact four-linkage pivoted cleaning blade mount in accordance to an embodiment. The holder 300 of blade 210 can be a four-linkage pivoted cleaning blade mount as shown in FIG. 3. The blade 210 is mounted to the coupler extension 325 of a four bar linkage. The holder 300 consists of board mounts 320 and 325, link rods 315, and link rod clamps 330 The board mounts consist of a blade mount 325 and a link mount 320. Link rods 315 are mounted on link mount 320 and retained by link rod clamps 330. The link rods 315 are the short offset portions of the bent rods. The link rod clamps 330 restrain the link rods 315 to rotation 350 against the blade holder and the printing apparatus or customer replaceable unit (CRU) frame 332. A single fastener such as a screw retains each link rod clamp. The link mount 320 of the four bar mechanism is loaded by a bias means 310 like a torsion spring, tension spring, compression spring or weight to supply the force 312 which creates the blade normal load, N. The blade mount 325 and the link mount 320 are located such that, when the blade 210 is loaded against the photoreceptor drum 108, lines passing through the offset portions of the link rods 315 intersect at the virtual pivot point 220. The four bar linkage apparatus need not be complicated and could be oriented in many different configurations to fit machine space requirements.

When the coefficient of friction rises such as when there is a residual toner adhering strongly to the surface of the photosensitive drum 108, a large stress is generated on the end of the blade 210, and with increase of this stress, the blade mount 325 is rotated in the direction of rotation 350 so as to allow the top end of the blade 210 to retreat and exchange the extra energy with the spring in bias means 310. Accordingly, the top end of the blade 210 is bent by a predetermined distance and is pressed or contacted strongly to the blade mount 325 causing the spring in the bias means 310 to compress reducing the blade load relative to the rise in the coefficient of friction.

FIG. 4 is a side view of a compact four-linkage pivoted cleaning blade mount in accordance to an embodiment. FIG. 4 is a partial schematic front view of the pivoted four-bar linkage. This view shows how the link rod clamps 320 retain the link rods 315 to the CRU frame 332 mounting surface and to the back blade holder 420. The link rods rotate within the link rod clamps 320. The link portion of the link rod is the vertical portion 410 of the bent link rods 315.

FIG. 5 shows curves illustrating the relationship of blade force and the friction coefficient on blade load (N) in accordance to an embodiment. FIG. 5 shows how an increase in the coefficient of friction increases blade load 520 and friction load 510 in a conventional interference loaded blade.

FIG. 6 shows curves illustrating the relationship of blade force and the friction coefficient on blade load (N) after adjustment of the blade in accordance to an embodiment. FIG. 6 shows how the pivoted cleaning blade mount described in FIG. 2 and FIG. 3 decreases blade load 520 when friction load 510 increases.

Figure 7:
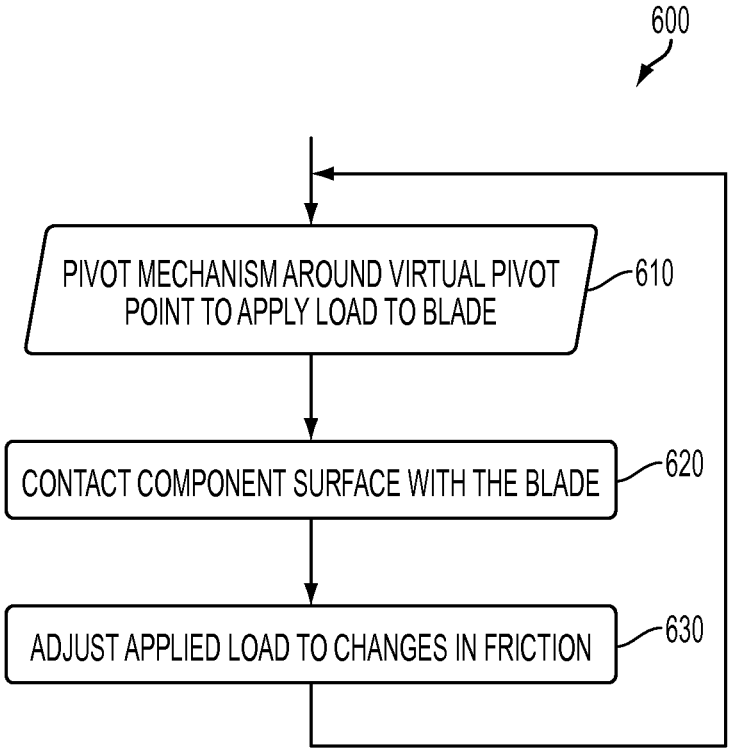
FIG. 7 is a flowchart of a method for treating a substance on a surface of a component in a printing apparatus with a blade member made of elastomeric material and a mechanism supporting pivotably the blade member in accordance to an embodiment.

FIG. 7 is a flowchart of a method 600 for treating a substance on a surface of a component in a printing apparatus with a blade member made of elastomeric material and a mechanism supporting pivotably the blade member in accordance to an embodiment. Method 600 is performed by the four-bar linkage pivoted cleaning blade as the mechanism adapts to changes in the coefficient of friction. Method 600 begins with positioning the pivot mechanism around a virtual pivot point to apply load to the blade. The pivot point controls the desired blade load at a given coefficient of friction. For example, the pivot point can be selected for the appropriate cleaning application that provides what is considered a good cleaning range such as 25 g/cm to 45 g/cm. In action 620 the blade is placed in contact with the component surface to perform cleaning operations with the appropriate blade load. In action 630 the holder 300 is allowed to adjust to changes in the coefficient of friction.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

It is believed that the foregoing description is sufficient for purposes of the present application to illustrate the general operation of an electrophotographic printing machine. Moreover, while the present invention is described in an embodiment of a single color printing system, there is no intent to limit it to such an embodiment. On the contrary, the present invention is intended for use in multi-color printing systems as well or any other printing system having a cleaner blade and toner. It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the followings claims.

What is claimed is:

1. A pivoted cleaning blade mount to remove residual material from a moving surface, comprising:

a blade member supported such that a blade tip on the blade member is biased towards the path of the moving surface, wherein the blade tip forms a first plane at a contact angle with a tangent to the moving surface and wherein the blade tip removes the residual material off said moving surface and said moving surface being lubricated prior to contacting said blade member; and a mechanism supporting pivotably the blade member having an instantaneous center of rotation in a second plane offset from the first plane, wherein the mechanism is a four-bar linkage with bias means;

wherein the mechanism is configured to reduce stress on the blade tip due to changes in coefficient of friction caused by aging or reduction in lubrication at the moving surface.

2. The pivoted cleaning blade mount according to claim 1, wherein the mechanism comprises board mounts, link rods, and link rod clamps.

3. The pivoted cleaning blade mount according to claim 2, wherein the blade member is supported along its entire extent by one of the board mounts.

4. The pivoted cleaning blade mount according to claim 2, wherein the mechanism is adapted to be mounted for pivotal movement.

5. The pivoted cleaning blade mount according to claim 2, wherein the mechanism is biased by means of a compression spring, tension spring, torsion spring or weight attached to the support.

6. The pivoted cleaning blade mount according to claim 5, wherein the link rods are connected to the board mounts.

7. The pivoted cleaning blade mount according to claim 6, wherein the link rods rotate within the link rod clamps.

8. An apparatus for treating a substance on a surface of a component, comprising:

a body comprising a free end portion including a first surface, the body being comprised of an elastomeric material and wherein the surface of the component being lubricated prior to contacting the first surface;

a fixed end opposite to the free end portion and fixedly secured to a mechanism supporting pivotably the body, wherein the mechanism is a four-bar linkage and wherein the body is pivoted about an instantaneous center of rotation offset from the surface of the component;

a second surface opposite to the first surface; and a bias means adapted to apply a load to the body such that the first surface of the body treats the substance on the surface of the component, wherein the bias means applies a force to the second surface of the body at the free end portion through the mechanism;

wherein the mechanism is configured to reduce stress on the first surface of the body due to changes in coefficient of friction caused by aging or reduction in lubrication at the surface of the component.

9. The apparatus according to claim 8, wherein the mechanism comprises board mounts, link rods, and link rod clamps.

10. The apparatus according to claim 9, wherein the fixed end is supported along its entire extent by one of the board mounts.

11. The apparatus according to claim 9, wherein the mechanism is adapted to be mounted for pivotal movement.

12. The apparatus according to claim 9, wherein the bias means is a compression spring, tension spring, torsion spring or weight attached to the support.

13. The apparatus according to claim 12, wherein the link rods are connected to the board mounts.

14. The apparatus according to claim 13, wherein the link rods rotate within the link rod clamps.

15. A method of treating a substance on a surface of a component in a printing apparatus with a blade member made of elastomeric material on a pivoted cleaning blade mount, the method comprising:

applying a load to the blade member by pivoting the mechanism about an instantaneous center of rotation offset from the surface of the component, wherein the load causes the blade member to contact the surface of the component and wherein the surface of the component is lubricated prior to contacting the blade member; and adjusting the load to the blade member to reduce stress due to changes in the coefficient of friction caused by aging or reduction in lubrication at the component, wherein the mechanism is a four-bar linkage with bias means.

16. A method according to claim 15, wherein the mechanism comprises board mounts, link rods, and link rod clamps.

17. A method according to claim 16, wherein the blade member is supported along its entire extent by one of the board mounts.

18. A method according to claim 16, wherein the mechanism is adapted to be mounted for pivotal movement.

19. A method according to claim 16, wherein the mechanism is biased by means of a compression spring, tension spring, torsion spring or weight attached to the support.

20. A method according to claim 19, wherein the link rods are connected to the board mounts and the link rods rotate within the link rod clamps.

* * * * *